US006296313B1

(12) United States Patent
Wu

(10) Patent No.: US 6,296,313 B1
(45) Date of Patent: Oct. 2, 2001

(54) ADJUSTING DEVICE FOR AN ARMREST OF A CHAIR

(75) Inventor: Wen-Long Wu, Taichung (TW)

(73) Assignee: Wen Sang Plastics Co., LTD (TW)

( * ) Notice: Subject to any disclaimer, the term of this patent is extended or adjusted under 35 U.S.C. 154(b) by 0 days.

(21) Appl. No.: 09/499,407

(22) Filed: Feb. 7, 2000

(51) Int. Cl.[7] ..... A47C 7/54; B60N 2/46

(52) U.S. Cl. ..... 297/411.35; 297/411.36; 297/353

(58) Field of Search ..... 297/411.35, 411.24, 297/411.36, 411.37, 411.45, 353

(56) References Cited

U.S. PATENT DOCUMENTS

| | | | | |
|---|---|---|---|---|
| 4,043,594 | * | 8/1977 | Cabell | 297/353 |
| 4,102,549 | * | 7/1978 | Morrison et al. | 297/353 X |
| 5,143,422 | * | 9/1992 | Althofer et al. | 297/411.36 |
| 5,324,096 | * | 6/1994 | Schultz | 297/411.36 |
| 5,435,626 | * | 7/1995 | Lai | 297/411.36 |
| 5,620,233 | * | 4/1997 | Corwin | 297/411.36 |
| 5,660,442 | * | 8/1997 | Tornero | 297/411.36 |
| 5,769,497 | * | 6/1998 | Tsai | 297/411.36 |
| 5,918,941 | * | 7/1999 | Kigel | 297/353 X |
| 6,062,646 | * | 5/2000 | Bock | 297/411.36 |
| 6,062,647 | * | 5/2000 | Mei | 297/411.36 |

* cited by examiner

*Primary Examiner*—Peter M. Cuomo
*Assistant Examiner*—Rodney B. White
(74) *Attorney, Agent, or Firm*—Connolly Bove Lodge & Hutz LLP

(57) ABSTRACT

An adjusting device for an armrest of a chair includes a first support base secured on the seat of the chair, an L-shaped adjusting arm having a horizontal section slidably mounted in the first support base, a lower retaining member mounted on the first support base for releasably securing the horizontal section of the adjusting arm to the first support base, a second support base secured on the armrest of the chair and slidably mounted on the vertical section of the adjusting arm, and an upper retaining member mounted on the second support base for releasably securing the second support base to the vertical section of the adjusting arm. In such a manner, the adjusting device can be used to arbitrarily adjust the horizontal and vertical positions of the armrest of the chair so that the armrest can be available for users of different statures so as to provide a comfortable sensation to the users, thereby increasing the versatility of the armrest.

5 Claims, 5 Drawing Sheets

ADJUSTING DEVICE FOR AN ARMREST OF A CHAIR

FIELD OF THE INVENTION

The present invention relates to an adjusting device, and more particularly to an adjusting device for an armrest of a chair.

DESCRIPTION OF THE RELATED ART

A conventional chair includes a lift device mounted on the bottom of the seat for vertically lifting/lowering the seat so as to properly adjust the height of the seat of the chair. However, the armrests of the conventional chair are respectively fixed on the two sides of the seat, and cannot be adjusted according to the need of a user so that the armrests of the conventional chair cannot suit users of different statures. Accordingly, the relative position of the two armrests is fixed and cannot be arbitrarily adjusted, thereby limiting the available space defined by the seat and the two armrests so that the users easily feel uncomfortable, thereby greatly decreasing the comfort and utility of the chair.

SUMMARY OF THE INVENTION

The present invention has arisen to mitigate and/or obviate the disadvantage of the armrests of the conventional chair.

In accordance with one aspect of the present invention, there is provided an adjusting device for an armrest of a chair comprising: a first support base secured on the seat of the chair; an L-shaped adjusting arm including a first section slidably mounted in the first support base; a first retaining member mounted on the first support base for releasably securing the first section of the adjusting arm to the first support base; a second support base secured on the armrest of the chair and slidably mounted on a second section of the adjusting arm; and a second retaining member mounted on the second support base for releasably securing the second support base to the second section of the adjusting arm.

The second section of the adjusting arm defines an elongated guide slot including a plurality of circular locking holes, and a plurality of slide tracks each located between two adjacent locking holes. The second support base includes a first side wall defining a first circular hole formed with a first annular flange, and a second wall defining a second circular hole formed with a second annular flange. The second retaining member includes an adjusting knob slidably received in the first circular hole, a slide stub mounted to the adjusting knob and slidably extending through the first annular flange to be slidable in the slide tracks of the guide slot, a biasing member mounted on the slide stub and pressed between the adjusting knob and the first annular flange, a locking knob slidably received in the second circular hole, and a locking stub mounted to the locking knob and slidably extending through the second annular flange to be secured to the slide stub and locked in the locking holes of the guide slot. The locking stub of the locking knob has a diameter greater than that of the slide stub of the adjusting knob.

The first section of the adjusting arm defines a recess. The first support base defines an elongated guide slot including a plurality of circular locking holes, and a plurality of slide tracks each located between two adjacent locking holes. The first retaining member includes a locking knob slidably received in the recess and abutting the first support base, a locking stub mounted to the locking knob and locked in the locking holes of the guide slot, a biasing member received in the recess and pressed between the first section of the adjusting arm and the locking knob, and an adjusting knob mounted on the first support base and having a slide stub secured to the locking stub to be slidable in the slide tracks of the guide slot. The locking stub of the locking knob has a diameter greater than that of the slide stub of the adjusting knob.

Further benefits and advantages of the present invention will become apparent after a careful reading of the detailed description with appropriate reference to the accompanying drawings.

DETAILED DESCRIPTION OF THE INVENTION

Figure 1:
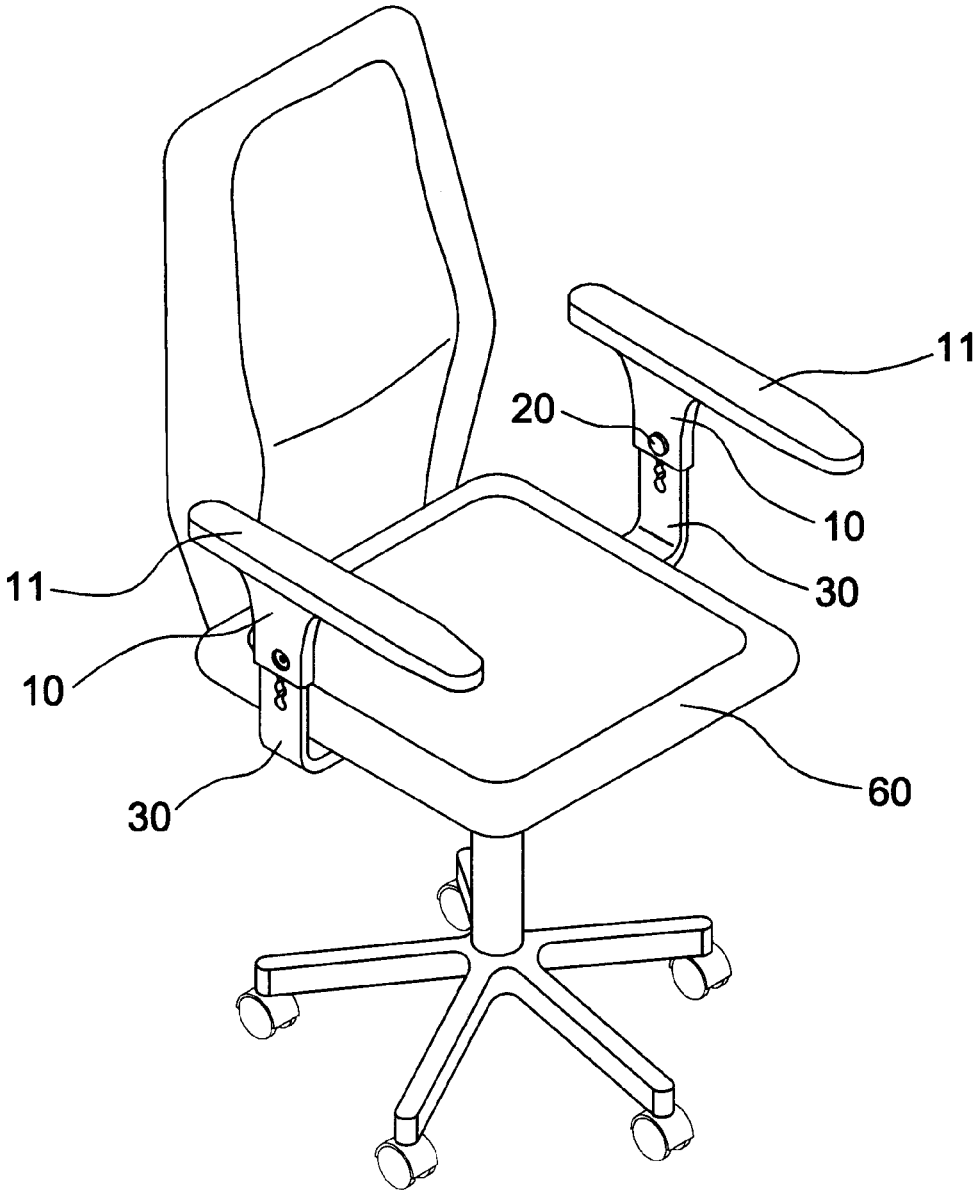
FIG. 1 is a perspective view of an adjusting device for an armrest of a chair in accordance with the present invention.
Figure 2:
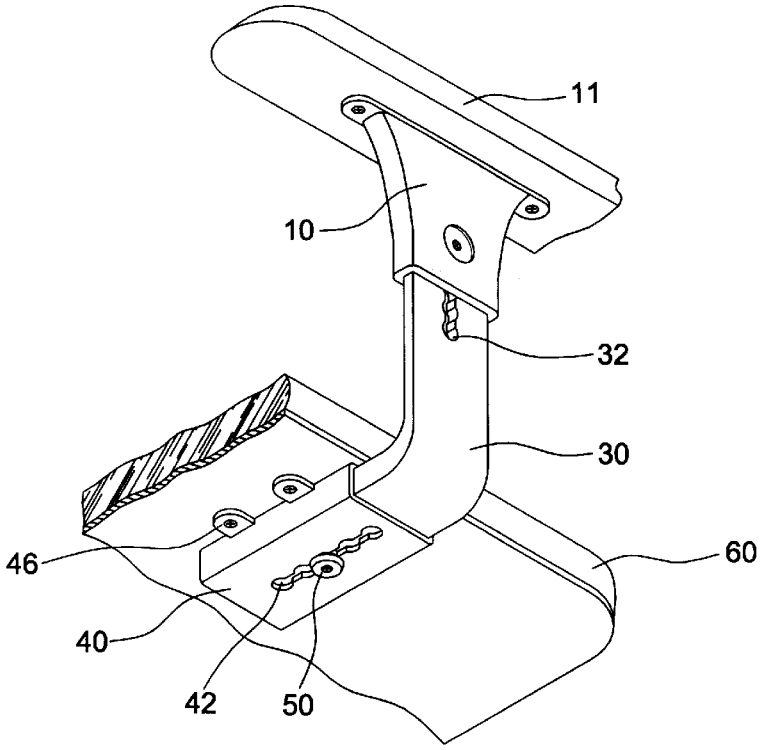
FIG. 2 is a partially cut-away bottom perspective view of the adjusting device as shown in FIG. 1.

Referring to the drawings and initially to FIGS. 1 and 2, an adjusting device in accordance with the present invention is used for adjusting armrests 11 of a chair. In assembly, two sets of adjusting devices are respectively mounted between the seat 60 and the two armrests 11 of the chair for adjusting the horizontal and vertical positions of the armrests 11. Each of the two sets of adjusting devices has the same symmetric structure so that only one set of adjusting device is described in the specification.

Referring to FIGS. 2–7 with reference to FIG. 1, the adjusting device comprises a first support base 40 secured on the seat 60 of the chair, an L-shaped adjusting arm 30 including a first section (or horizontal section) slidably mounted in the first support base 40, a first retaining member mounted on the first support base 40 for releasably securing the first section of the adjusting arm 30 to the first support base 40, a second support base 10 secured on the armrest 11 of the chair and slidably mounted on the second section (or vertical section) of the adjusting arm 30, and a second retaining member mounted on the second support base 10 for releasably securing the second support base 10 to the second section of the adjusting arm 30.

Figure 5:
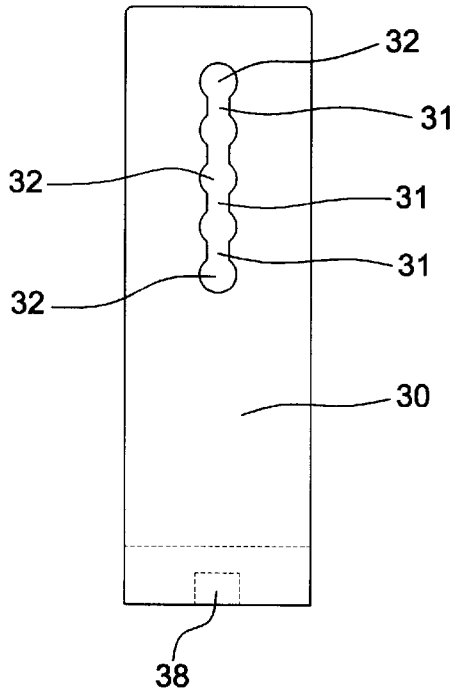
FIG. 5 is a front plan view of an L-shaped adjusting arm of the adjusting device as shown in FIG. 2.

As shown in FIG. 5, the vertical section of the adjusting arm 30 defines an elongated guide slot including a plurality of circular locking holes 32, and a plurality of slide tracks 31 each located between two adjacent locking holes 32. Each of the circular locking holes 32 has a diameter greater than the dimension of each of the slide tracks 31.

Figure 4:
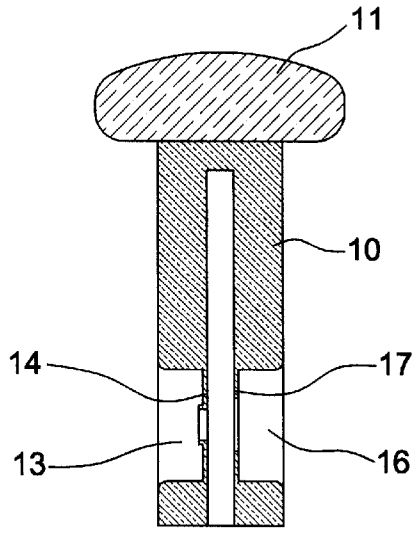
FIG. 4 is a front plan partially cut-away cross-sectional view of the adjusting device as shown in FIG. 2.

As shown in FIG. 4, the second support base 10 is a hollow bracket and includes a first side wall defining a first circular hole 13 formed with a first annular flange 14, and a second wall defining a second circular hole 16 formed with a second annular flange 17.

Figure 3:
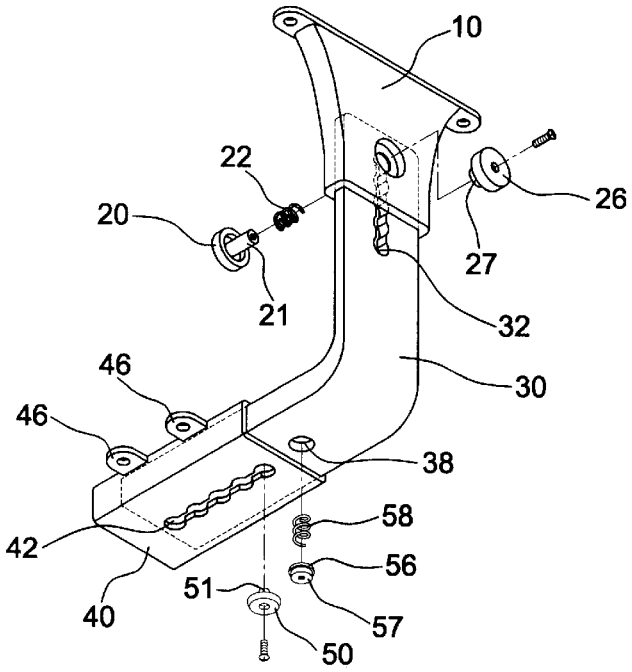
FIG. 3 is an exploded view of the adjusting device as shown in FIG. 2.
Figure 7:
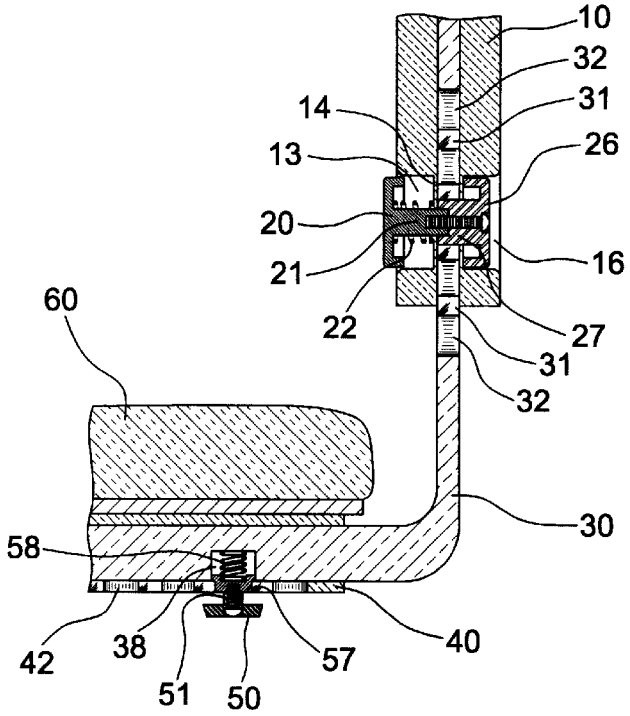
FIG. 7 is a front plan cross-sectional view of the adjusting device as shown in FIG. 2.

As shown in FIGS. 3 and 7, the second (or upper) retaining member includes an upper adjusting knob 20 slidably received in the first circular hole 13, a slide stub 21 extending from the upper adjusting knob 20 and slidably extending through the first annular flange 14 to be slidable in the slide tracks 31 of the guide slot, a biasing member, preferably a spring 22, mounted on the slide stub 21 and pressed between the upper adjusting knob 20 and the first annular flange 14, an upper locking knob 26 slidably received in the second circular hole 16, a locking stub 27 extending from the upper locking knob 26 and slidably extending through the second annular flange 17 to be secured to the slide stub 21 by means of a screw (not numbered) and locked in the locking holes 32 of the guide slot. The locking stub 27 of the upper locking knob 26 has a diameter greater than that of the slide stub 21 of the upper adjusting knob 20.

Figure 6:
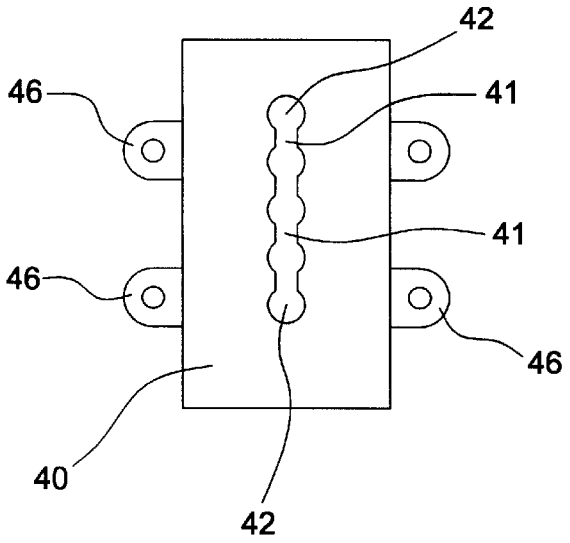
FIG. 6 is a bottom plan view of a support base of the adjusting device as shown in FIG. 2.

As shown in FIG. 6, the first support base 40 is a rectangular hollow bracket and defines an elongated guide slot including a plurality of circular locking holes 42, and a plurality of slide tracks 41 each located between two adjacent locking holes 42. Each of the circular locking holes 42 has a diameter greater than the dimension of each of the slide tracks 41. A plurality of mounting ears 46 are each mounted on a periphery of the first support base 40 for securing the first support base 40 to the seat 60 by means of a plurality of screws (not numbered).

Figure 8:
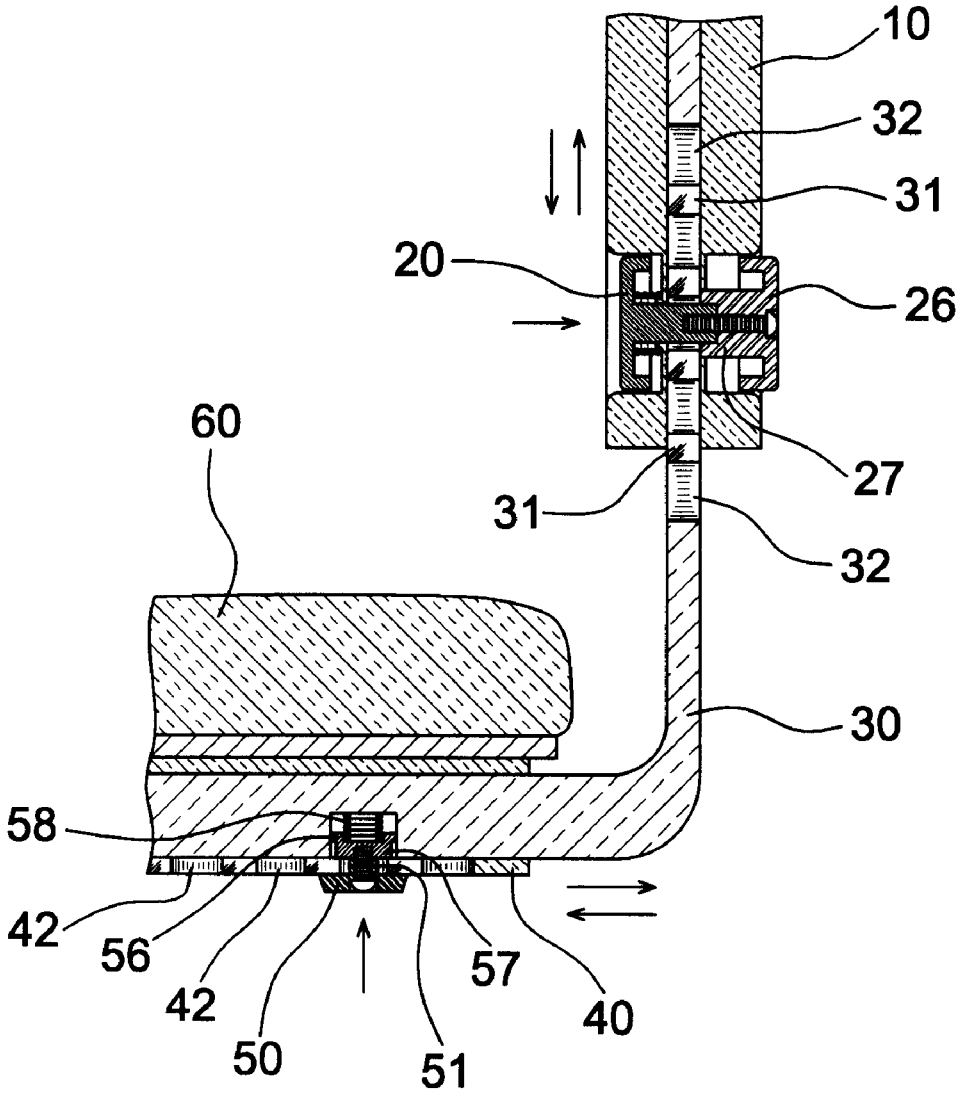
FIG. 8 is an operational view of the adjusting device as shown in FIG. 7.

In operation, referring to FIGS. 7 and 8 with reference to FIGS. 1–6, the locking stub 27 of the upper locking knob 26 is initially retained in one of the locking holes 32 as shown in FIG. 7 so that the second support base 10 is secured on the vertical section of the adjusting arm 30, thereby fixing the armrest 11.

The upper adjusting knob 20 can then be pressed inward from the position as shown in FIG. 7 to the position as shown in FIG. 8 to move the slide stub 21 into the locking hole 32, thereby detaching the locking stub 27 from the locking hole 32. In such a manner, the slide stub 21 can slide in the slide tracks 31 of the guide slot so that the second support base 10 can be moved relative to the vertical section of the adjusting arm 30 so as to lift or lower the armrest 11, thereby arbitrarily adjusting the vertical position of the armrest 11. The upper adjusting knob 20 can then be pushed outward to its original position by means of the restoring force of the spring 22, thereby again securing the armrest 11.

Now, again referring to FIGS. 7 and 8 with reference to FIGS. 1–6, the locking stub 57 of the lower locking knob 56 is initially retained in one of the locking holes 42 as shown in FIG. 7 so that the horizontal section of the adjusting arm 30 is secured on the first support base 40, thereby fixing the armrest 11.

The lower adjusting knob 50 can then be pressed upward from the position as shown in FIG. 7 to the position as shown in FIG. 8 to move the slide stub 51 into the locking hole 42, thereby detaching the locking stub 57 from the locking hole 42. In such a manner, the slide stub 51 can slide in the slide tracks 41 of the guide slot so that the horizontal section of the adjusting arm 30 can be moved relative to the first support base 40 so as to move the armrest 11 in a horizontal manner, thereby arbitrarily adjusting the horizontal position of the armrest 11. The lower adjusting knob 50 can then be pushed downward to its original position by means of the restoring force of the spring 58, thereby again securing the armrest 11.

Accordingly, the adjusting device in accordance with the present invention can be used to arbitrarily adjust the horizontal and vertical positions of the armrest 11 so that the armrest 11 can be available for users of different statures so as to provide a comfortable sensation to the users and to increase the comfort of the armrests 11 for the users, thereby greatly increasing the versatility of the armrest 11.

It should be clear to those skilled in the art that further embodiments may be made without departing from the scope of the present invention.

What is claimed is:

1. An adjusting device in combination with a chair, said chair including a seat (60) and an armrest (11), said adjusting device comprising:

a first support base (40) secured on said seat (60);

an L-shaped adjusting arm (30) including a first section and a second section, said first section slidably mounted in said first support base (40);

a first retaining member mounted on said first support base (40) for releasably securing said first section of said adjusting arm (30) to said first support base (40);

a second support base (10) secured on said armrest (11) and slidably mounted on said second section of said adjusting arm (30); and a second retaining member mounted on said second support base (10) for releasably securing said second support base (10) to said second section of said adjusting arm (30); wherein said second section of said adjusting arm (30) defines an elongated guide slot including a plurality of circular locking holes (32), and a plurality of slide tracks (31) each located between two adjacent locking holes (32), said second support base (10) includes a first side wall defining a first circular hole (13) formed with a first annular flange (14), and a second wall defining a second circular hole (16) formed with a second annular flange (17), and said second retaining member includes an adjusting knob (20) slidably received in said first circular hole (13), a circular slide stub (21) mounted to said adjusting knob (20) and slidably extending through said first annular flange (14) to be slidable in said slide tracks (31) of said guide slot, a biasing member (22) mounted on said slide stub (21) and pressed between said adjusting knob (20) and said first annular flange (14), a locking knob (26) slidably received in said second circular hole (16), a circular locking stub (27) mounted to said locking knob (26) and slidably extending through said second annular flange (17) to be secured to said slide stub (21) and locked in said locking holes (32) of said guide slot.

2. The adjusting device in accordance with claim 1, wherein said locking stub (27) of said locking knob (26) has a diameter greater than that of said slide stub (21) of said adjusting knob (20).

3. The adjusting device in accordance with claim 1, wherein said first section of said adjusting arm (30) defines a recess (38), said first support base (40) defines an elongated guide slot including a plurality of circular locking holes (42), and a plurality of slide tracks (41) each located between two adjacent locking holes (42), and said first retaining member includes a locking knob (56) slidably received in said recess (38) and abutting said first support base (40), a circular locking stub (57) mounted to said locking knob (56) and locked in said locking holes (42) of said guide slot, a biasing member (58) received in said recess (38) and pressed between said first section of said adjusting arm (30) and said locking knob (56), and an adjusting knob (50) mounted on said first support base (40) and having a circular slide stub (51) secured to said locking stub (57) to be slidable in said slide tracks (41) of said guide slot.

4. The adjusting device in accordance with claim 3, wherein said locking stub (57) of said locking knob (56) has a diameter greater than that of said slide stub (51) of said adjusting knob (50).

5. The adjusting device in accordance with claim 1, further comprising a plurality of mounting cars (46) each mounted on a periphery of said first support base (40).

* * * * *